US006991539B2

(12) United States Patent
Pacey

(10) Patent No.: US 6,991,539 B2
(45) Date of Patent: Jan. 31, 2006

(54) GRAPHIC ADVENTURE GAMING MACHINE

(75) Inventor: Larry J. Pacey, Prospect Heights, IL (US)

(73) Assignee: WMS Gaming Inc., Waukegan, IL (US)

( * ) Notice: Subject to any disclaimer, the term of this patent is extended or adjusted under 35 U.S.C. 154(b) by 190 days.

(21) Appl. No.: 10/059,454

(22) Filed: Jan. 29, 2002

(65) Prior Publication Data

US 2003/0144049 A1 Jul. 31, 2003

(51) Int. Cl.
*A63F 9/24* (2006.01)

(52) U.S. Cl. ..... 463/16; 463/20

(58) Field of Classification Search ..... 463/15, 463/16, 20, 30–34
See application file for complete search history.

(56) References Cited

U.S. PATENT DOCUMENTS

| | | | | |
|---|---|---|---|---|
| 6,015,346 | A | 1/2000 | Bennett | 463/20 |
| 6,089,976 | A | 7/2000 | Schneider et al. | 463/16 |
| 6,099,409 | A * | 8/2000 | Brenner et al. | 463/40 |
| 6,102,798 | A * | 8/2000 | Bennett | 463/16 |
| 6,159,097 | A * | 12/2000 | Gura | 463/20 |
| 6,190,255 | B1 | 2/2001 | Thomas et al. | 463/20 |
| 6,261,177 | B1 | 7/2001 | Bennett | 463/16 |
| 6,306,036 | B1 * | 10/2001 | Burns et al. | 463/31 |
| 6,554,707 | B1 * | 4/2003 | Sinclair et al. | 463/39 |
| 6,645,073 | B2 * | 11/2003 | Lemay et al. | 463/20 |
| 6,652,377 | B1 * | 11/2003 | Moody | 463/13 |
| 2003/0064805 | A1 * | 4/2003 | Wells | 463/39 |

FOREIGN PATENT DOCUMENTS

| | | | |
|---|---|---|---|
| GB | 2144644 A | * | 3/1985 |
| WO | WO 98/09258 | | 3/1998 |
| WO | WO 98/09259 | | 3/1998 |

* cited by examiner

*Primary Examiner*—Julie Brocketti
(74) *Attorney, Agent, or Firm*—Jenkens & Gilchrist

(57) ABSTRACT

A graphic adventure gaming machine and method of conducting a game of chance on the gaming machine are disclosed. The machine portrays an adventure scene including a plurality of selectable objects. The machine receives a selection from a player of at least one of the selectable objects and receives a wager associated with the selection. The machine awards any outcome associated with the selected object. The outcome may, for example, include a payoff, bonus game, animated event, video clip, sound clip, transition to new adventure scene or location within the adventure scene, adding an item associated with the selected object to a persistent inventory, unlocking or revealing new selectable objects within the adventure scene, zooming into the selected object, and progressing a story of which the adventure scene is a part.

61 Claims, 7 Drawing Sheets

GRAPHIC ADVENTURE GAMING MACHINE

FIELD OF THE INVENTION

The present invention relates generally to gaming machines and, more particularly, to a graphic adventure gaming machine and method that allow a player to wager on a selection of at least one of a plurality of selectable objects included in a portrayed adventure scene. The selected object may yield a variety of outcomes.

BACKGROUND OF THE INVENTION

Video gaming machines, such as video slots, video poker, and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning each machine is roughly the same (or believed to be the same), players are most likely to be attracted to the most entertaining and exciting of the machines. Shrewd operators consequently strive to employ the most entertaining and exciting machines available because such machines attract frequent play and hence increase profitability to the operator.

Video gaming machines are typically operable to play such traditional games as slots, poker, bingo, keno, and blackjack. Such games have been enhanced in recent years to include first and second screen bonus features. Due to the proliferation of such bonus features and the repeated use of similar (or even identical) bonus features in different games, many of the enhanced games now appear to be ordinary and mundane. Accordingly, in the competitive gaming machine industry, there is a continuing need for gaming machine manufacturers to produce new types of games, or enhancements to existing games, which will attract frequent play by enhancing the entertainment value and excitement associated with the game.

SUMMARY OF THE INVENTION

These and other objects are realized by a graphic adventure gaming machine and method of conducting a game of chance on the gaming machine. The machine portrays an adventure scene including a plurality of selectable objects. The machine receives a selection from a player of at least one of the selectable objects and receives a wager associated with the selection. The machine awards any outcome associated with the selected object. The outcome may, for example, include a payoff, bonus game, animated event, video clip, sound clip, transition to new adventure scene or location within the adventure scene, adding an item associated with the selected object to a persistent inventory, unlocking or revealing new selectable objects within the adventure scene, zooming into the selected object, and progressing a story of which the adventure scene is a part.

BRIEF DESCRIPTION OF THE DRAWINGS

The foregoing and other advantages of the invention will become apparent upon reading the following detailed description and upon reference to the drawings.

Figure 1:
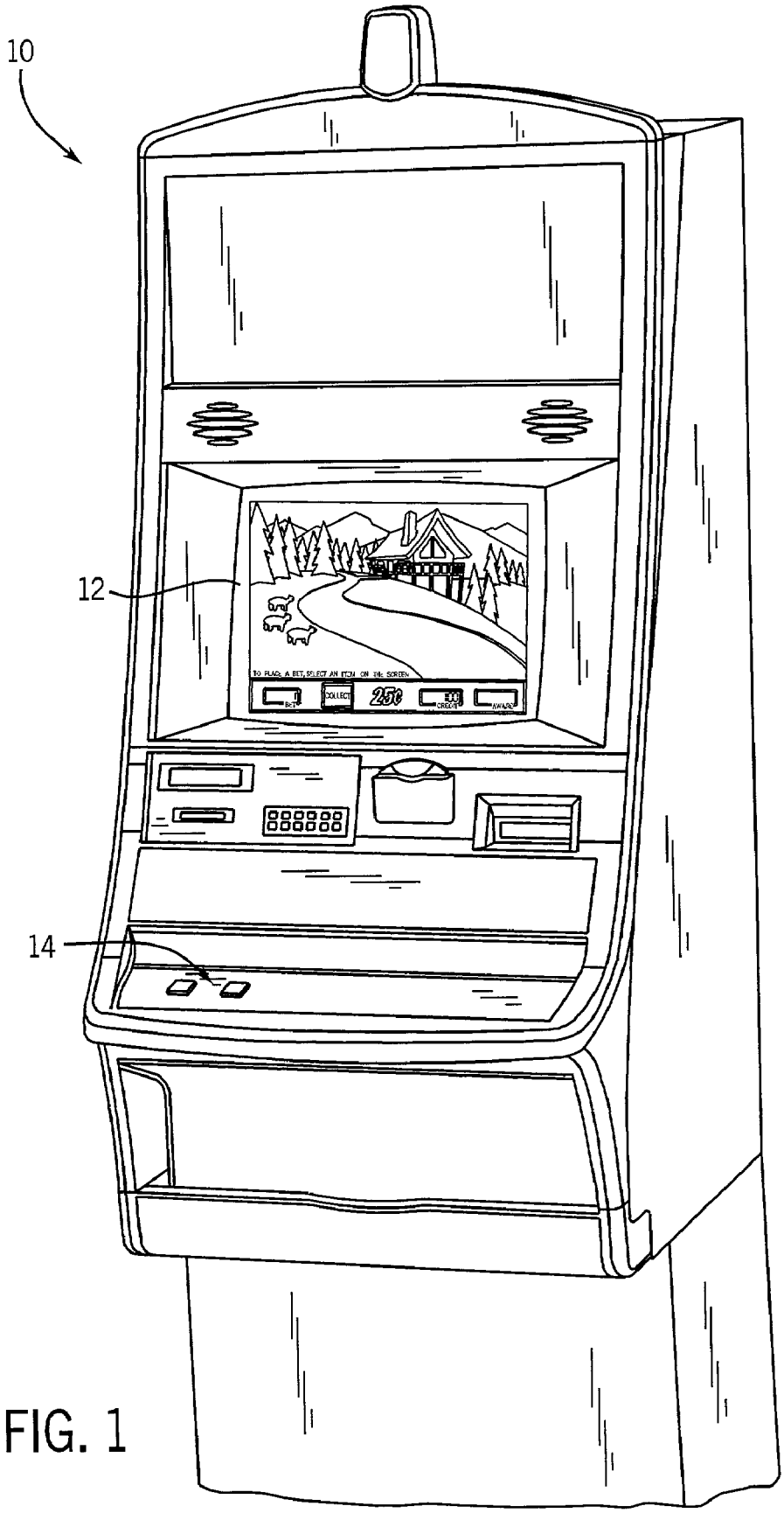
FIG. 1 is an isometric view of a graphic adventure gaming machine embodying the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DESCRIPTION OF ILLUSTRATIVE EMBODIMENTS

Turning now to the drawings and referring initially to FIG. 1, a graphic adventure gaming machine 10 is operable to conduct a game of chance that allows a player to wager on a selection of at least one of a plurality of selectable objects included in a portrayed adventure scene. The selected object may yield a variety of outcomes. The gaming machine 10 includes a visual display 12 preferably in the form of a dot matrix, CRT, LED, LCD, electro-luminescent, or other type of video display known in the art. The display 12 preferably includes a touch screen overlaying the monitor. In the illustrated embodiment, the gaming machine 10 is an "upright" version in which the display 12 is oriented vertically relative to the player. Alternatively, the gaming machine may be a "slant-top" version in which the display 12 is slanted at about a thirty-degree angle toward the player of the gaming machine 10.

Figure 2:
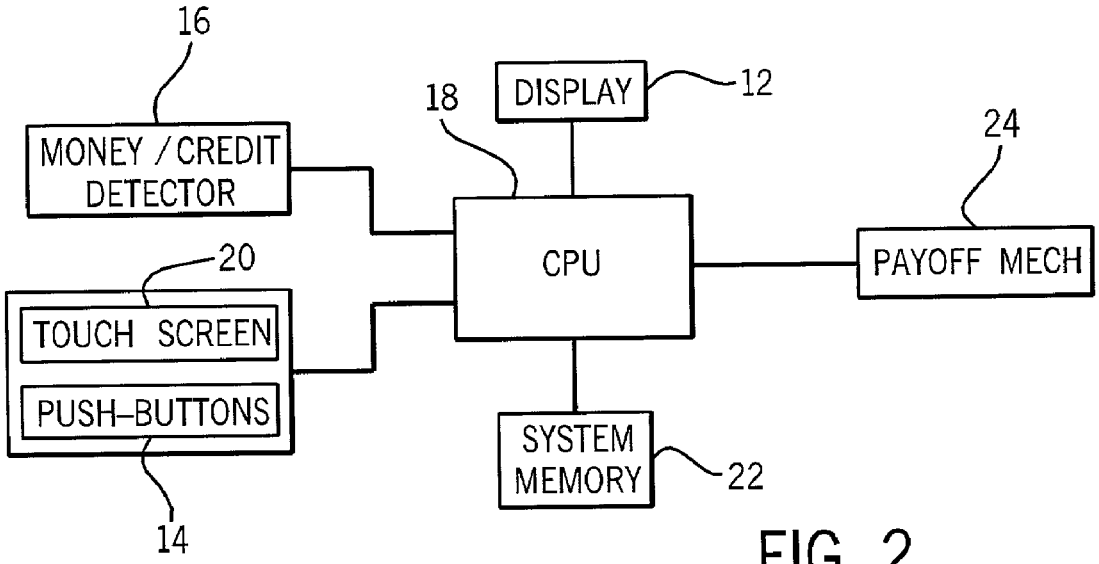
FIG. 2 is a block diagram of a control system suitable for operating the gaming machine.
Figure 3:
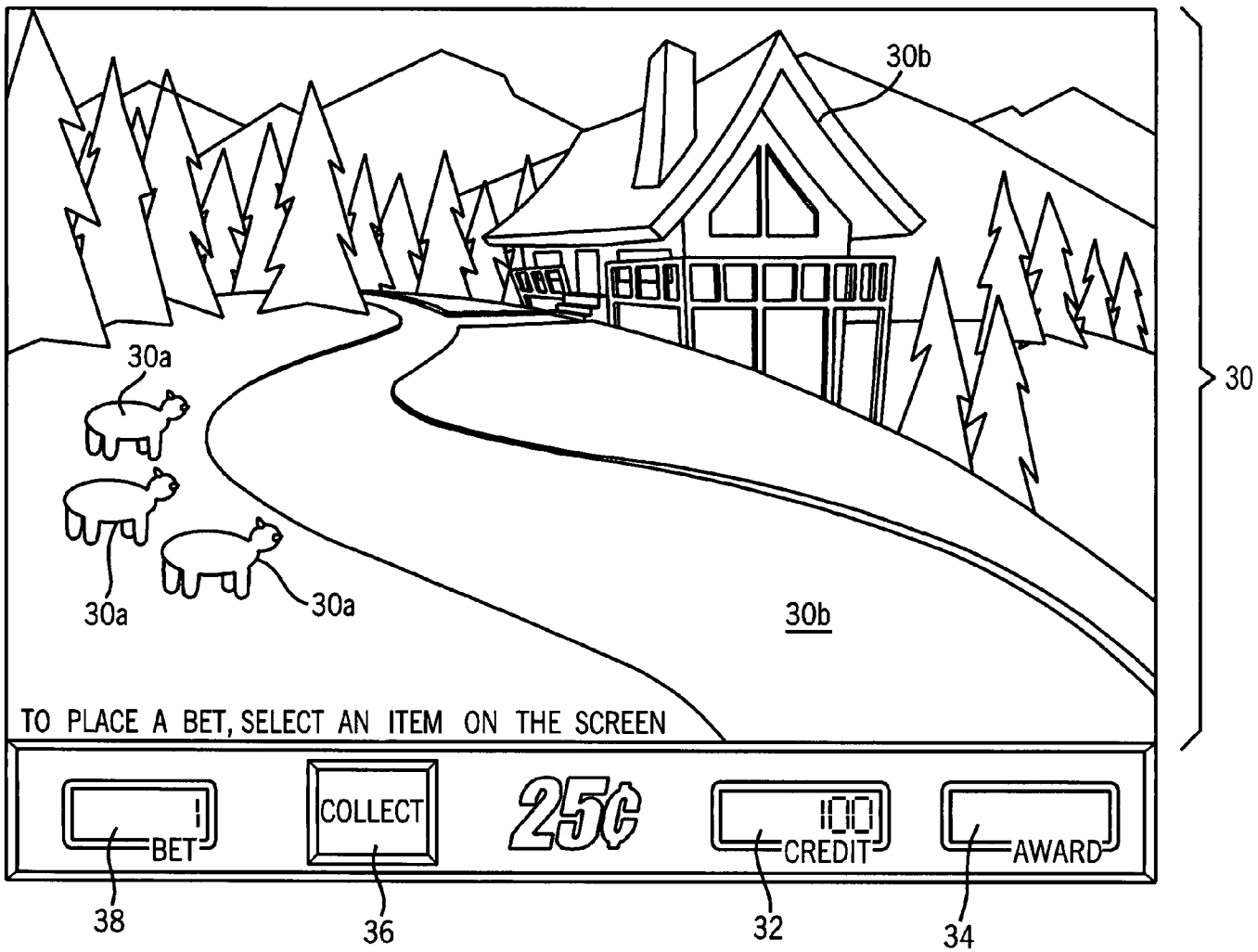
FIGS. 3 through 7 are display screen images associated with the graphic adventure gaming machine.

FIG. 2 is a block diagram of a control system suitable for operating the gaming machine 10. Money/credit detector 16 signals a central processing unit ("CPU") 18 when a player has inserted money or placed a wager. The money may be provided by coins, bills, tickets, coupons, cards, etc. The CPU 18 executes a game program that causes the video display 12 to portray an adventure scene including a plurality of selectable objects. The CPU 18 randomly associates outcomes with the respective selectable objects. To place a wager, the CPU 18 prompts the player to select at least one of the selectable objects by touching the object on the video display 12. The video display 12 is outfitted with a touch screen 20. In response to the player's selection of the object(s), the CPU 18 awards the outcome associated with the selected object and reveals the outcome on the display 12.

A system memory 22 stores control software, operational instructions and data associated with the gaming machine 10. In one embodiment, the system memory 22 comprises a separate read-only memory (ROM) and battery-backed random-access memory (RAM). However, it will be appreciated that the system memory 22 may be implemented on any of several alternative types of memory structures or may be implemented on a single memory structure. A payoff mechanism 24 is operable in response to instructions from the CPU 18 to award a payoff to the player in response to any outcomes that include a payoff. The payoff may, for example, be in the form of a number of credits. The number of credits are determined by one or more pay tables stored in the system memory 22. In addition to the touch screen 20, the gaming machine 10 may include a plurality of push-buttons 14 for implementing such functions as calling an attendant or collecting any credits on the game's credit meter. Also, the machine 10 may be outfitted with a user pointing device such as a mouse or trackball and/or with a different user button interface such as a keyboard.

Referring to FIGS. 3 through 7, the graphic adventure gaming machine generally provides a "click-pay", story-based adventure in which a player can create a story through extended game play. The video display 12 portrays an adventure scene including a plurality of selectable objects 30. The adventure scene may, for example, be based on a photo-tour of an exotic location or a fantasy setting where the environment is created with two-dimensional or three-dimensional artwork. The adventure scene may be portrayed in a first person perspective of a player or a third person perspective of an onscreen character. The selectable objects 30 are associated with respective outcomes. The CPU uses a random number generator (RNG) to randomly assign the outcomes to the respective objects 30. Game play essentially involves a "click-pay" play mechanic in which the player pays for each selection of one of the selectable objects 30, and each selected object reveals its associated outcome.

To play the game, the player must first load credits onto a credit meter 32 by inserting money into the machine. The game may be set up to make each credit worth any coin denomination. The number of loaded credits is equal to the amount of inserted money divided by the monetary value of each credit. For example, if the player inserts 20 dollars and each credit is worth 25 cents, the number of loaded credits is equal to 80 credits.

To place a wager (i.e., bet), the game prompts and permits the player to directly select one of the selectable objects 30 preferably using the touch screen. The selectable objects 30 may include passive items 30*a*, navigational items 30*b*, and portals 30*c*. The passive items 30*a* may, for example, include phones, pictures, animals, road signs, food, plants, paper goods, books, bookshelves, personal effects, furniture, lamps/lights, vehicles, and sculptures. The navigational items 30*b* may, for example, include forward, turnaround, back, left, right, up, and down. In the illustrated example, the navigational items 30*b* include the road and the house. The portals 30*c* may, for example, include doors, bridges, drawers, curtains, windows, and fireplaces/chimneys.

In response to selecting one of the selectable objects 30, the game deducts a credit from the credit meter 32, shows the wagered credit on a bet meter 38, and highlights the selected object. Also, the game awards the outcome associated with the selected object and reveals the outcome on the video display 12. Just prior to revealing the outcome, if the adventure scene is portrayed in a first person perspective of the player the first person perspective may move toward the selected object. Similarly, if the adventure scene is portrayed in a third person perspective of an onscreen character, the onscreen character may move toward the selected object.

Figure 4:
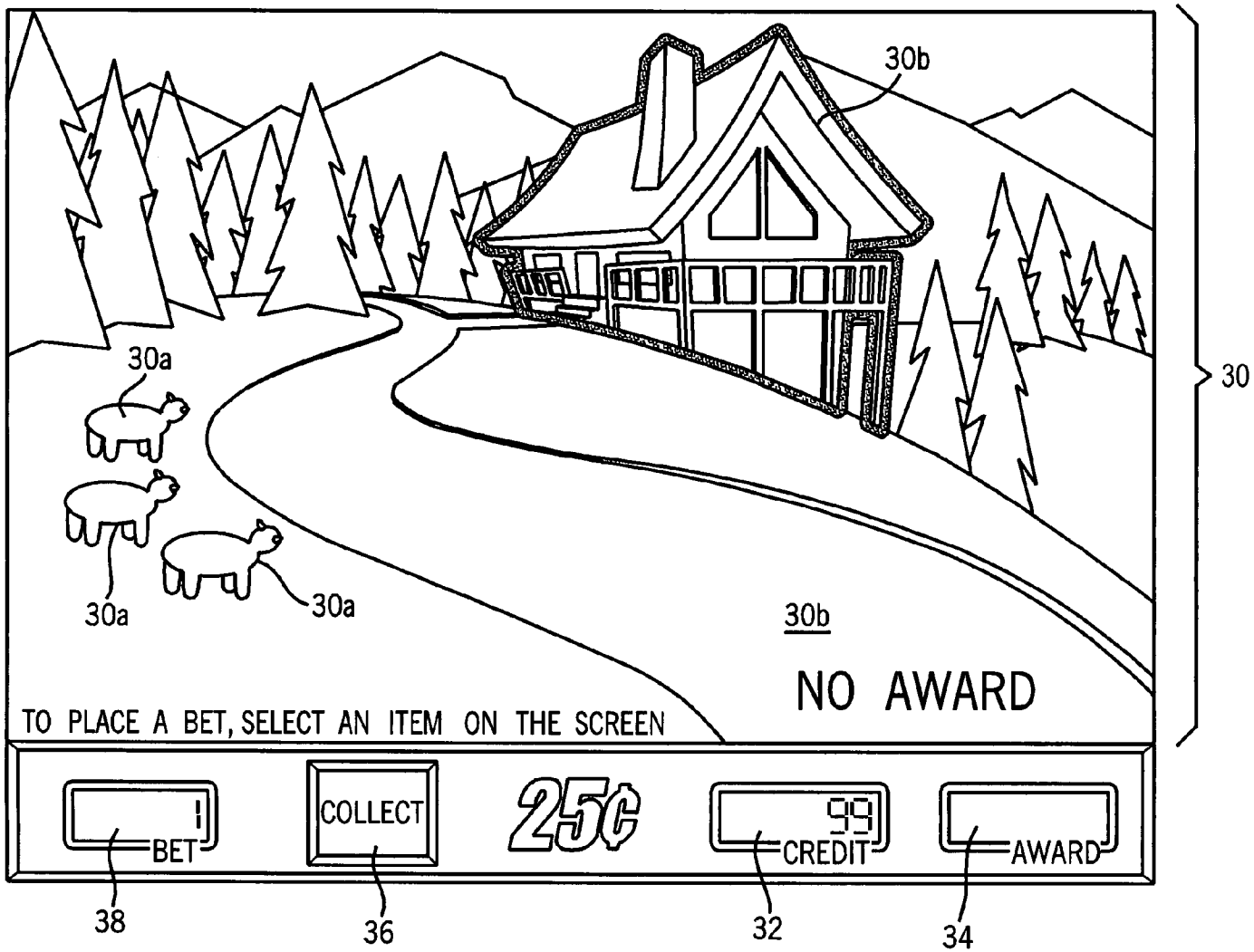
Figure 5:
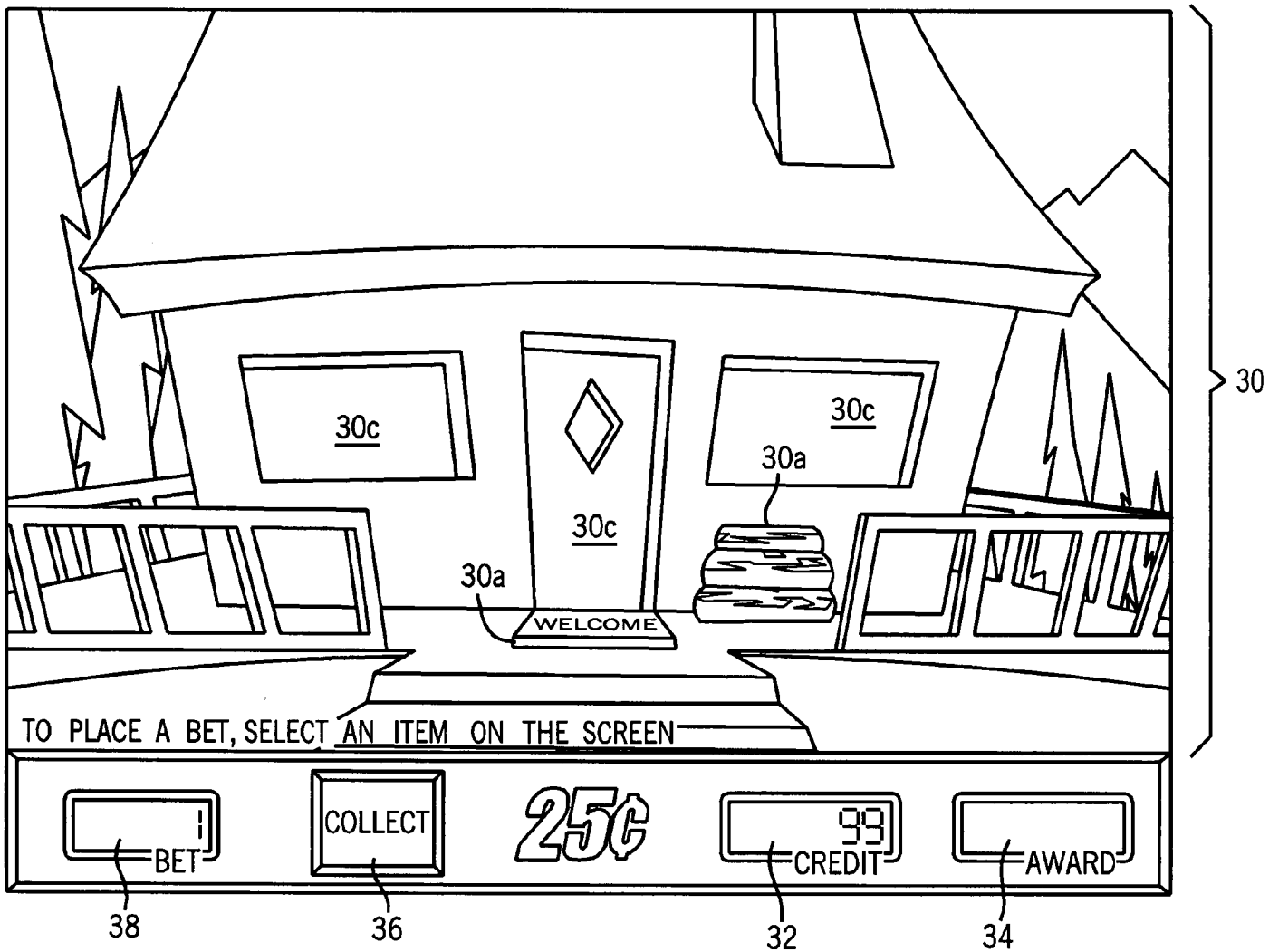
Figure 6:
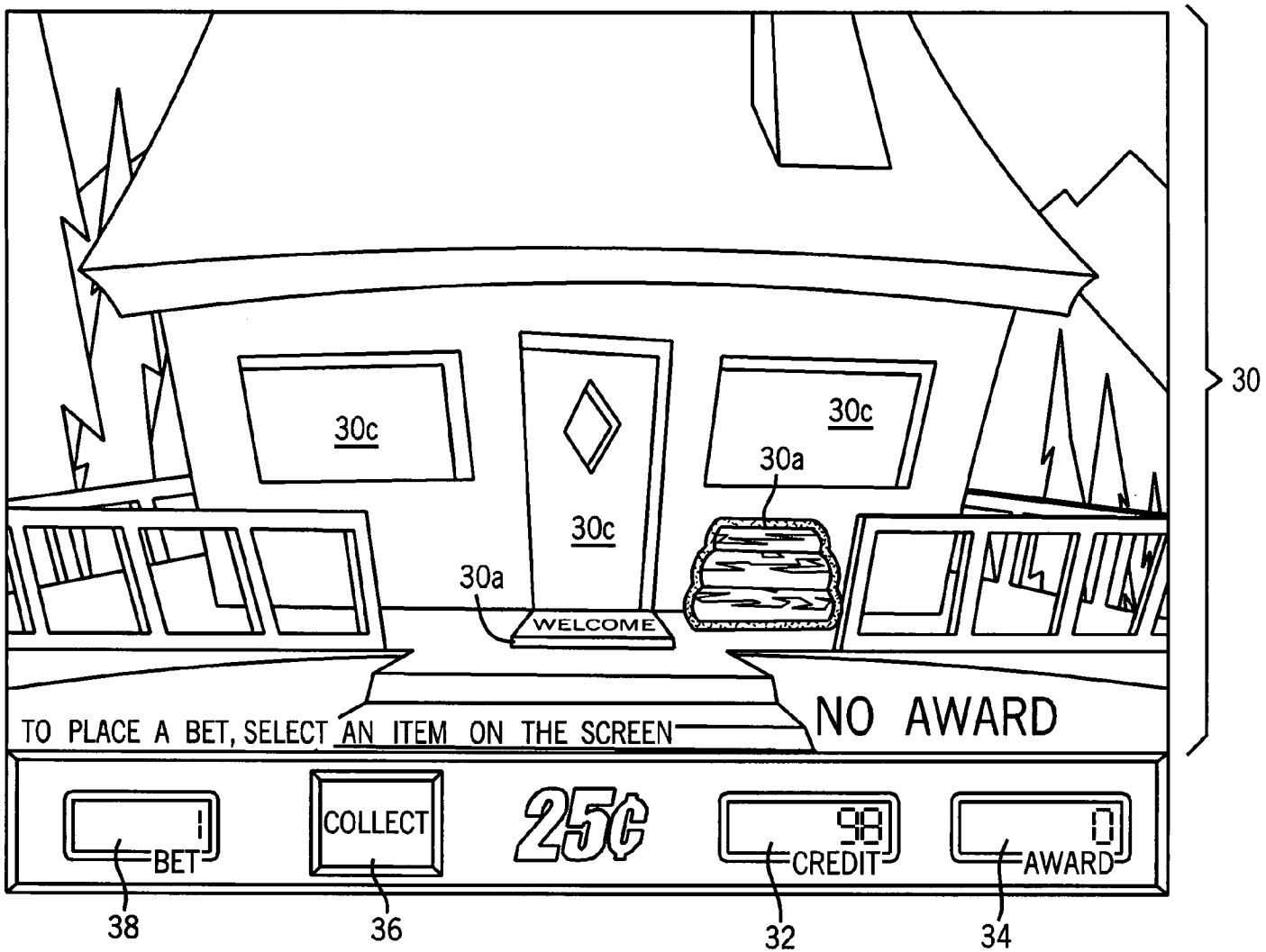
Figure 7:
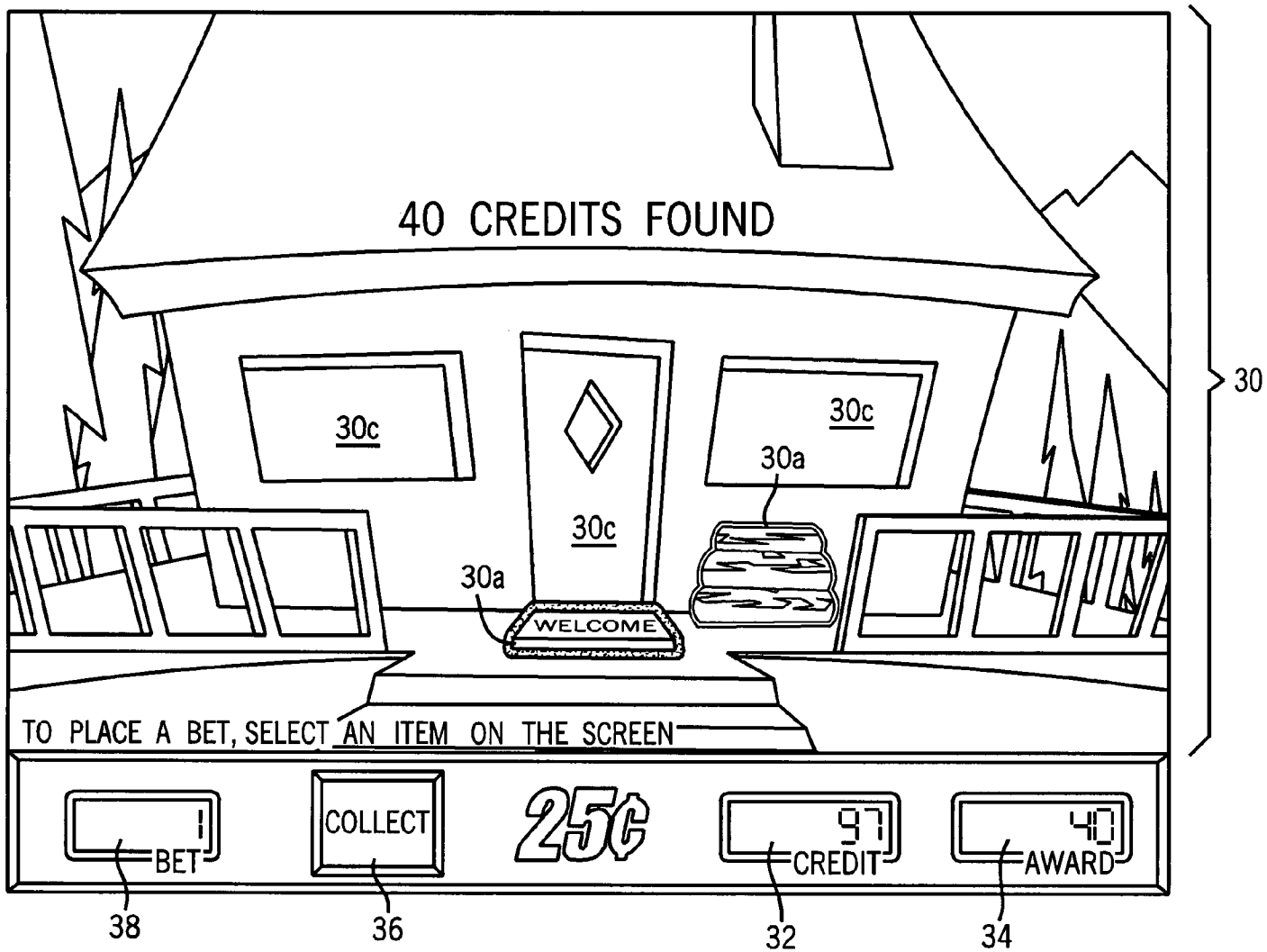

The revealed outcome may, for example, includes no payoff as in FIG. 4 for selecting the house and in FIG. 6 for selecting the logs; a payoff as in FIG. 7 for selecting the welcome mat; a bonus game such as slots, poker, bingo, keno, roulette, craps, blackjack, racing, or an interactive selection game; an animated event; a video clip; a sound clip; a transition to a new adventure scene or a location within the adventure scene; adding an item associated with the selected object to a persistent inventory (e.g., key, note, clue, gem, card, book, map); unlocking or revealing new selectable objects within the adventure scene; zooming into the selected object, e.g. a closeup of the house in FIG. 5; and if the adventure scene is part of a story, progressing the story. If the revealed outcome is a payoff, the payoff is preferably in the form of a number of credits that are first shown on an award meter 34 as in FIG. 7 and then added to the credit meter 32. If the revealed outcome is a bonus game, the bonus game may present different play mechanics to the player and provide the player with additional opportunities to win money. Upon completion of a triggered bonus game, the CPU shifts operation of the gaming machine from the bonus game back to the "click-pay" adventure scene.

The player may repeat the above "click-pay" play mechanic of placing a wager and selecting one of the selectable objects 30 to reveal an associated outcome until the player no longer wishes to play the graphic adventure gaming machine. Upon completion of play, the player may collect any credits remaining on the credit meter 32 by pressing an onscreen or physical "Collect" button 36.

While the present invention has been described with reference to one or more particular embodiments, those skilled in the art will recognize that many changes may be made thereto without departing from the spirit and scope of the present invention. For example, the graphic adventure gaming machine 10 may be linked to other graphic adventure gaming machines. This would allow players on the different machines to share the same game space and work together to explore the selectable objects 30 in the adventure scene and discover prizes. Furthermore, instead of placing a wager by selecting an object 30 on the display, the wagering step may be separate from and precede the selection step. The player may, for example, first select a desired number of credits to wager by pressing an onscreen or physical "BET" button a number of times corresponding to the desired number of wagered credits, and then directly select one of the selectable objects 30 using the touch screen. Each of these embodiments and obvious variations thereof is contemplated as falling within the spirit and scope of the claimed invention, which is set forth in the following claims:

What is claimed is:

1. A method of conducting a game of chance on a gaming machine, comprising:

portraying an adventure scene including a plurality of selectable objects, the plurality of selectable objects includes different types of objects, including passive, navigational, and portal objects, each selectable object being associated with a randomly selected outcome, the portraying of the adventure scene includes simultaneously displaying at least two different types of objects in the adventure scene, wherein the at least two different types of objects are capable of being selected from the adventure scene;

receiving a selection from a player of at least one of the selectable objects;

receiving a wager associated with the selection of the at least one of the selectable objects;

receiving a second wager associated with another selection of the at least one of the selectable objects; and awarding the randomly selected outcome associated with each of the selected objects.

2. The method of claim 1, wherein the outcome includes a payoff.

3. The method of claim 1, wherein the outcome includes a bonus game.

4. The method of claim 3, wherein the bonus game is selected from a group consisting of slots, poker, bingo, keno, roulette, craps, blackjack, racing, and an interactive selection game.

5. The method of claim 1, wherein the outcome includes an animated event.

6. The method of claim 1, wherein the outcome includes a video or sound clip.

7. The method of claim 1, wherein the outcome includes a transition to new adventure scene or location within the adventure scene.

8. The method of claim 1, wherein the outcome includes adding an item associated with the selected object to a persistent inventory.

9. The method of claim 1, wherein the outcome includes unlocking or revealing new selectable objects within the adventure scene.

10. The method of claim 1, wherein the outcome includes zooming into the selected object.

11. The method of claim 1, wherein the adventure scene is part of a story, and wherein the outcome includes progressing the story.

12. The method of claim 1, wherein the adventure scene is portrayed in a first person perspective of the player.

13. The method of claim 12, further including moving the first person perspective toward the selected object.

14. The method of claim 1, wherein the adventure scene is portrayed in a third person perspective of an onscreen character.

15. The method of claim 14, further including moving the onscreen character toward the selected object.

16. The method of claim 1, wherein the wager includes a player-selected number of betting units.

17. The method of claim 1, wherein the receiving of a selection includes receiving the selection via a touch screen overlying a display that portrays the adventure scene.

18. The method of claim 1, wherein the passive objects are selected from a group consisting of phones, pictures, animals, road signs, food, plants, paper goods, books, bookshelves, personal effects, furniture, lamps/lights, vehicles, and sculptures.

19. The method of claim 1, wherein the navigational objects are selected from a group consisting of forward, turnaround, back, left, right, up, and down.

20. The method of claim 1, wherein the portals are selected from a group consisting of doors, bridges, drawers, curtains, windows, and fireplaces/chimneys.

21. The method of claim 1, wherein the receiving of the wager is responsive to receiving the selection of the at least one of the selectable objects.

22. The method of claim 1, wherein the receiving of the wager occurs prior to receiving the selection of the at least one of the selectable objects.

23. The method of claim 1, wherein the receiving of the second wager is responsive to the receiving of the another selection of at least one of the selectable objects.

24. The method of claim 1, wherein the receiving of the second wager occurs prior to the receiving of the another selection of at least one of the selectable objects.

25. A graphic adventure gaming machine, comprising:

means for portraying an adventure scene including a plurality of selectable objects, the plurality of selectable objects includes different types of objects, including passive, navigational, and portal objects, each selectable object being associated with a randomly selected outcome, the portraying of the adventure scene includes simultaneously displaying at least two different types of objects in the adventure scene, wherein the at least two different types of objects are capable of being selected from the adventure scene;

means for receiving a selection from a player of at least one of the selectable objects;

means for receiving a wager associated with the selection of the at least one of the selectable objects;

means for receiving a second wager associated with another selection of the at least one of the selectable objects; and means for awarding the randomly selected outcome associated with each of the selected objects.

26. The machine of claim 25, wherein the outcome includes a payoff.

27. The machine of claim 25, wherein the outcome includes a bonus game.

28. The machine of claim 27, wherein the bonus game is selected from a group consisting of slots, poker, bingo, keno, roulette, craps, blackjack, racing, and an interactive selection game.

29. The machine of claim 25, wherein the outcome includes an animated event.

30. The machine of claim 25, wherein the outcome includes a video or sound clip.

31. The machine of claim 25, wherein the outcome includes a transition to new adventure scene or location within the adventure scene.

32. The machine of claim 25, wherein the outcome includes adding an item associated with the selected object to a persistent inventory.

33. The machine of claim 25, wherein the outcome includes unlocking or revealing new selectable objects within the adventure scene.

34. The machine of claim 25, wherein the outcome includes zooming into the selected object.

35. The machine of claim 25, wherein the adventure scene is part of a story, and wherein the outcome includes progressing the story.

36. The machine of claim 25, wherein the adventure scene is portrayed in a first person perspective of the player.

37. The machine of claim 36, further including means for moving the first person perspective toward the selected object.

38. The machine of claim 25, wherein the adventure scene is portrayed in a third person perspective of an onscreen character.

39. The machine of claim 38, further including means for moving the onscreen character toward the selected object.

40. The machine of claim 25, wherein the wager includes a player-selected number of betting units.

41. The machine of claim 25, wherein the means for receiving the player's selection includes a touch screen overlying the portraying means.

42. The machine of claim 25, wherein the portraying means includes a video display.

43. The machine of claim 25, wherein the passive objects are selected from a group consisting of phones, pictures, animals, road signs, food, plants, paper goods, books, bookshelves, personal effects, furniture, lamps/lights, vehicles, and sculptures.

44. The machine of claim 25, wherein the navigational objects are selected from a group consisting of forward, turnaround, back, left, right, up, and down.

45. The machine of claim 25, wherein the portals are selected from a group consisting of doors, bridges, drawers, curtains, windows, and fireplaces/chimneys.

46. The machine of claim 25, wherein the means for receiving the wager is responsive to the means for receiving the selection of the at least one of the selectable objects.

47. The machine of claim 25, wherein the means for receiving the wager operates prior to the means for receiving the selection of the at least one of the selectable objects.

48. The machine of claim 25, wherein the means for receiving the second wager is responsive to the means for receiving the another selection of the at least one of the selectable objects.

49. The machine of claim 25, wherein the means for receiving the second wager operates prior to the means for receiving the another selection of the at least one of the selectable objects.

50. A method of playing a gaming machine that portrays an adventure scene including a plurality of selectable objects, comprising:

making a selection of at least one of said selectable objects, each selectable object being associated with a randomly selected outcome, the adventure scene and selectable objects associated with a common theme;

paying for the selection by making a wager;

providing to the player the randomly selected outcome associated with the selected object; and after the providing and while the adventure scene remains the same, allowing the player to continue selecting at least another one of the selectable objects and receiving additional wagers for each selectable object selected.

51. The method of claim 50, wherein the plurality of selectable objects include passive objects that are selected from a group consisting of phones, pictures, animals, road signs, food, plants, paper goods, books, bookshelves, personal effects, furniture, lamps/lights, vehicles, and sculptures.

52. The method of claim 50, wherein the plurality of selectable objects include navigational objects that are selected from a group consisting of forward, turnaround, back, left, right, up, and down.

53. The method of claim 50, wherein the plurality of selectable objects include portals selected from a group consisting of doors, bridges, drawers, curtains, windows, and fireplaces/chimneys.

54. A method of conducting a game of chance on a gaming machine, comprising:

portraying an adventure scene including a plurality of selectable objects, the selectable objects including different types of selectable objects, including passive, navigational and portal objects, and wherein at least two different types of objects are capable of being selected from the adventure scene, each selectable object being associated with a randomly selected outcome;

receiving a selection from a player of at least one of the selectable objects;

after receiving the selection from the player of at least one of the selectable objects, receiving a wager associated with the selection;

awarding any outcome associated with the selected object;

receiving another selection of at least one of the selectable objects while portraying the adventure scene;

after receiving the another selection, receiving a second wager associated with the another selection; and awarding any outcome associated with the another selected object.

55. The method of claim 54, wherein the portraying of an adventure scene includes simultaneously displaying the at least two different types of objects in the adventure scene.

56. A method of conducting a game of chance on a gaming machine, comprising:

portraying an adventure scene including a plurality of selectable objects, the selectable objects including different types of selectable objects, including passive, navigational and portal objects, and wherein at least two different types of objects are capable of being selected from the adventure scene, each selectable object being associated with a randomly selected outcome;

selecting, via the player, a plurality of the selectable objects;

receiving a wager associated with the selection for each selection made by the player, wherein a first wager that is received is associated with a first selected object and a second wager that is received is associated with a second selected object; and awarding the randomly selected outcome associated with the first and second selected objects.

57. The method of claim 56, wherein the randomly selected outcome includes providing a different adventure scene having different player selectable objects.

58. The method of claim 56, wherein the randomly selected outcome includes providing the same adventure scene having the same player selectable objects.

59. The method of claim 56, wherein the portraying of an adventure scene includes simultaneously displaying the at least two different types of objects in the adventure scene.

60. A method of conducting a game of chance on a gaming machine, comprising:

portraying a first adventure scene including a plurality of selectable objects, each selectable object being associated with a randomly selected outcome, the selectable objects including different types of selectable objects, including passive, navigational and portal objects, and wherein at least two different types of objects are capable of being selected from the adventure scene, receiving a selection from a player of at least one of the selectable objects;

receiving a wager associated with the selection;

advancing to a second adventure scene in response to receiving a selection of a certain one of the selectable objects, the second adventure scene displaying a plurality of selectable objects, the selectable objects displayed in the second adventure scene being different from the selectable objects displayed in the first adventure scene; and receiving a second wager associated with a selection from the second adventure scene.

61. The method of claim 60, wherein the portraying of an adventure scene includes simultaneously displaying the at least two different types of objects in the adventure scene.

* * * * *